United States Patent [19]

Griffin

[11] Patent Number: 4,969,241

[45] Date of Patent: Nov. 13, 1990

[54] BUTTON COVER ASSEMBLY

[76] Inventor: Joetta R. Griffin, 2330 Elliott Dr., American Canyon, Calif. 94589

[21] Appl. No.: 486,295

[22] Filed: Feb. 28, 1990

[51] Int. Cl.[5] ..... A44B 1/12

[52] U.S. Cl. ..... 24/113 R; 24/113 MP; 24/92

[58] Field of Search ..... 24/113 R, 113 MP, 92, 24/108, 104, 102 A

[56] References Cited

U.S. PATENT DOCUMENTS

| | | | |
|---|---|---|---|
| 336,063 | 2/1886 | Palmer | 24/113 MP |
| 1,397,957 | 11/1921 | Gulick | 24/113 R |
| 1,690,129 | 11/1928 | Prentiss | 24/108 |
| 2,433,986 | 1/1948 | Forbes | 24/92 |
| 2,983,009 | 5/1961 | Dritz | 24/113 R |
| 3,142,878 | 8/1964 | Santora | 24/113 R |
| 3,242,544 | 3/1966 | Dritz | 24/113 R |
| 3,787,935 | 1/1974 | Kapitan | 24/113 MP |
| 4,035,874 | 7/1977 | Liljendahl | 24/113 MP |

FOREIGN PATENT DOCUMENTS

| | | | |
|---|---|---|---|
| 622990 | 5/1949 | United Kingdom | 24/113 R |

*Primary Examiner*—Victor N. Sakran
*Attorney, Agent, or Firm*—Leon Gilden

[57] ABSTRACT

An apparatus wherein a first embodiment includes a dome cover assembly, including spaced parallel resilient legs for directing through associated apertures of a button, with projections directed orthogonally relative to the legs to lock the cover relative to the button. A further embodiment of the instant invention includes a cover assembly mounted to a button disk, wherein the button disk includes a semi-annular loop orthogonally oriented relative to a bottom surface of the disk for securement to a garment. The cover is optionally formed of magnetic material to receive a magnetically attractive covering disk thereon to enable replacement of covers as desired by an individual. The embodiment further includes a resilient polymeric dome mounted to overlie the cover disk and plate, wherein the resilient dome is optionally formed including a matrix of deformable wire formed therethrough. The resilient dome may accordingly be reshaped as desired to various configurations in use.

4 Claims, 4 Drawing Sheets

PRIOR ART

BUTTON COVER ASSEMBLY

BACKGROUND OF THE INVENTION

1. Field of the Invention

The field of invention relates to button cover organizations, and more particularly pertains to a new and improved button cover assembly to enable selective securement of variously colored covers to an associated button.

2. Description of the Prior Art

Button cover organizations have been presented in the prior art to provide an individual an option to vary coloration and configuration of a button covering relative to a garment or fabric to be adorned by the associated button. Button covers of the prior art have heretofore been of either a relatively unnecessarily complex organization or have heretofore failed to provide an individual user the alternatives available by the instant invention to provide button coverings of various colorations, as well as configurations. Examples of the prior art include U.S. Pat. No. 4,035,874 to Liljendahal providing a main button body formed with an annular recess, with a coaxially and rearwardly oriented stem provided with a central tubular core to receive an attachment plate thereto, wherein a button covering means is directed into the annular recess of the button body.

U.S. Pat. No. 3,500,507 to Malhenzie provides a button cover assembly resiliently mounted overlying an annular base, wherein the base is provided with a stem for securement to a fabric support.

U.S. Pat. No. 3,787,935 to Kapitan sets forth a self-attaching button assembly wherein a pronged support plate is directed through a fabric and then through a socketed body, with a covering mounted to the body subsequent to assembly.

U.S. Pat. No. 3,715,781 to Salvatori provides a button securing organization wherein a stem is directed through a fabric support receivable within a button body, and wherein the button body includes a disk receivable within an annular recess of the button body.

U.S. Pat. No. 4,471,546 to Bolling, Jr. wherein a button assembly kit utilizes a pronged member receivable within a support plate for use in providing an identification indicator onto an animal appendage.

As such, it may be appreciated that there continues to be a need for a new and improved button cover assembly wherein the same addresses both the problems of ease of use, as well as enabling an individual creativity and selectivity in providing a completed button assemblage selectively securable to a garment or fabric support base.

SUMMARY OF THE INVENTION

In view of the foregoing disadvantages inherent in the known types of button cover organizations now present in the prior art, the present invention provides a button cover assembly wherein the same is selectively and readily securable to a fabric support base and is further deformable to enable creativity in the covering and designing of button and button cover organizations. As such, the general purpose of the present invention, which will be described subsequently in greater detail, is to provide a new and improved button cover assembly which has all the advantages of the prior art button cover organizations and none of the disadvantages.

To attain this, the present invention provides an apparatus wherein a first embodiment includes a dome cover assembly, including spaced parallel resilient legs for directing through associated apertures of a button, with projections directed orthogonally relative to the legs to lock the cover relative to the button. A further embodiment of the instant invention includes a cover assembly mounted to a button disk, wherein the button disk includes a semi-annular loop orthogonally oriented relative to a bottom surface of the disk for securement to a garment. The cover is optionally formed of magnetic material to receive a magnetically attractive covering disk thereon to enable replacement of covers as desired by an individual. The embodiment further includes a resilient polymeric dome mounted to overlie the cover disk and plate, wherein the resilient dome is optionally formed including a matrix of deformable wire formed therethrough. The resilient dome may accordingly be reshaped as desired to various configurations in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved button cover assembly which has all the advantages of the prior art button cover organizations and none of the disadvantages.

It is another object of the present invention to provide a new and improved button cover assembly which may be easily and efficiently manufactured and marketed.

It is a further object of the present invention to provide a new and improved button cover assembly which is of a durable and reliable construction.

An even further object of the present invention is to provide a new and improved button cover assembly which is susceptible of a low cost of manufacture with regard to both materials and labor, and which accordingly is then susceptible of low prices of sale to the consuming public, thereby making such button cover assemblies economically available to the buying public.

Still yet another object of the present invention is to provide a new and improved button cover assembly which provides in the apparatuses and methods of the prior art some of the advantages thereof, while simultaneously overcoming some of the disadvantages normally associated therewith.

Still another object of the present invention is to provide a new and improved button cover assembly wherein the same is selectively and readily securable to a garment or fabric support base enabling selective covering of the assembly with a myriad of colorations and configurations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
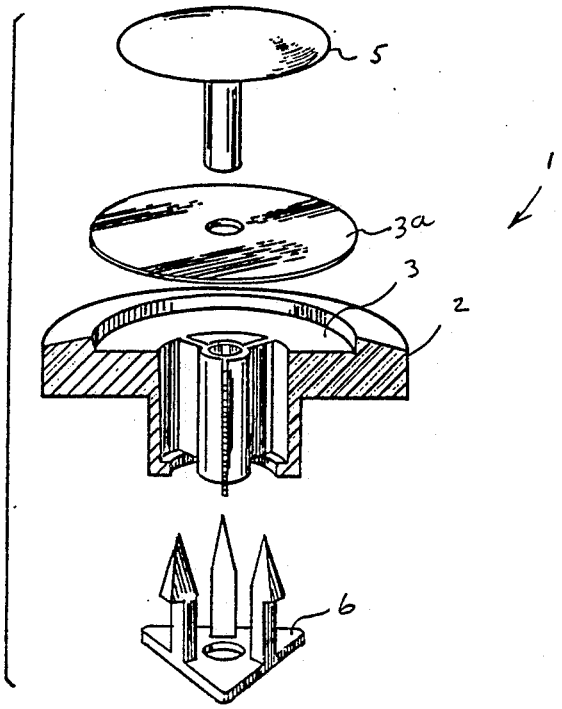
FIG. 1 is an isometric illustration of a prior art button cover assembly.

With reference now to the drawings, and in particular to FIGS. 1 to 11 thereof, a new and improved button cover assembly embodying the principles and concepts of the present invention and generally designated by the reference numerals 10, **10*a*, and 10*b*** will be described.

Figure 2:
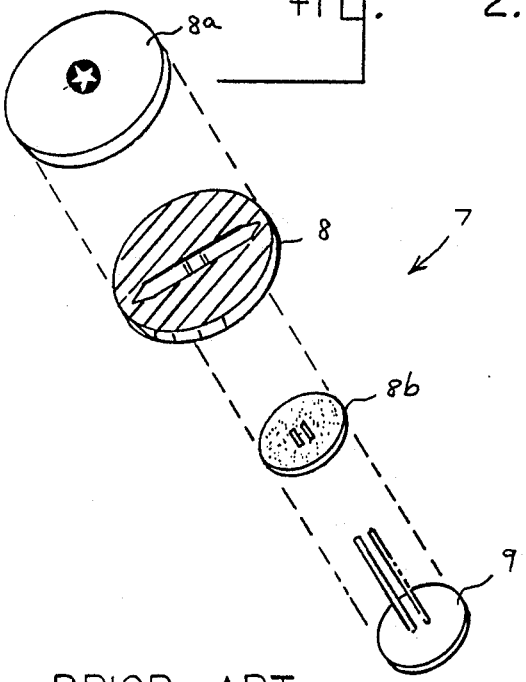
PRIOR ART FIG. 2.
FIG. 2 is an isometric illustration of a further example of a button cover assembly.
Figure 3:
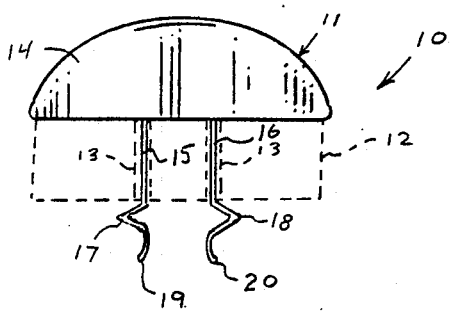
FIG. 3 is an orthographic side view taken in elevation of the instant invention.

FIG. 1 illustrates a prior art button cover assembly 1 utilizing a support body 2 formed with an annular recess 3 to receive a disk **3*a* and cover 5, with a support plate 6 directed into a stem of the body to secure a fabric between the body and the plate 6. FIG. 2 illustrates a further prior art button cover assembly 7 wherein a button 8 utilizes a cover 8*a*, with fabric support 8*b* therebetween, with a pronged support 9 directed through the fabric support and into the button 8 subsequently covered by the aforenoted cover 8*a***.

Figure 4:
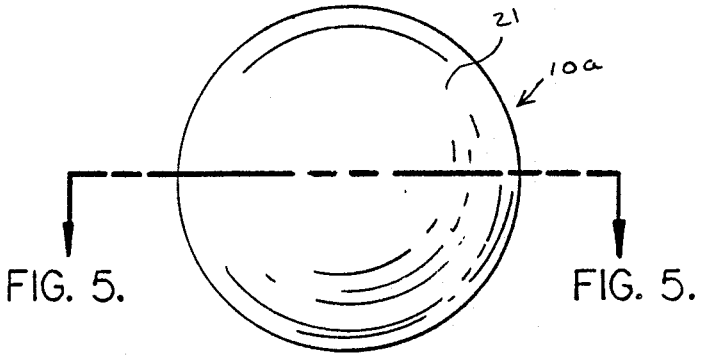
FIG. 4 is a top orthographic view of a modification of the instant invention.
Figure 5:
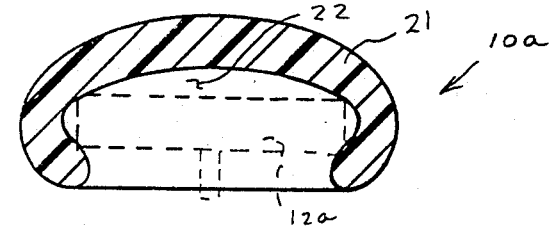
FIG. 5 is an orthographic view taken along the lines 5—5 of FIG. 4 in the direction indicated by the arrows.

More specifically, the button cover assembly 10 of the instant invention essentially comprises a button cover member 11 for securement overlying an associated cylindrical button 12. The button 12 includes spaced button apertures 13 directed orthogonally through the button to receive spaced legs of the button cover member 11. The legs are defined by a first resilient leg 15 parallel to and spaced from a second resilient leg 16. The legs each include a respective first and second projection 17 and 18 directed orthogonally and exteriorly of the legs and the button member which is further defined by a hemispherical cover 14 substantially equal to or greater than a diameter defined by the button 12. Each of the legs terminates at its lower end in a respective first and second arcuate end portion 19 and 20 to minimize abrasion to a fabric underlying the button 12 when the legs 15 and 16 are directed through the button 12. Reference to FIG. 4 illustrates a further button cover assembly **10*a* defined by a resilient polymeric dome 21 of a generally "C" shaped cross-sectional configuration, as illustrated in FIG. 5, defining a central cavity 22 to receive the button 12 therewithin. The central cavity 22 is defined by a diameter less than or equal to the diameter of the button 12*a***.

Figure 6:
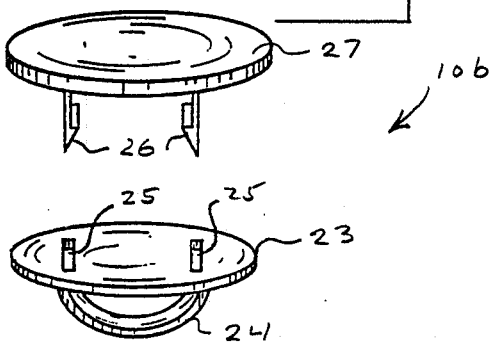
FIG. 6 is an isometric illustration of a further embodiment of the instant invention.

FIG. 6 sets forth a further modified button cover assembly **10*b* wherein a disk 23 includes a plurality of spaced parallel slots 25 directed therethrough at equal distance to either side of an axis defined by the disk 23 defined by a spaced distance. A plurality of spaced parallel resilient hooks 26 spaced apart a distance equal to the spaced distance, and wherein each of the hooks 26 are of a width equal to the width of the slots 25. A semi-annular ring 24 is orthogonally mounted at its ends to a bottom surface of the disk 23 for securement to an underlying support garment. An annular cover plate 27 is orthogonally mounted to upper ends of the resilient hooks 26**.

Figure 7:
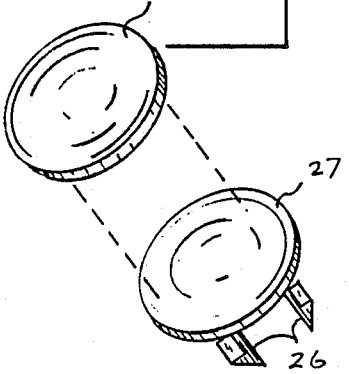
FIG. 7 is an isometric illustration of the embodiment of the invention, as illustrated in FIG. 6, utilizing a magnetic covering plate.
Figure 8:
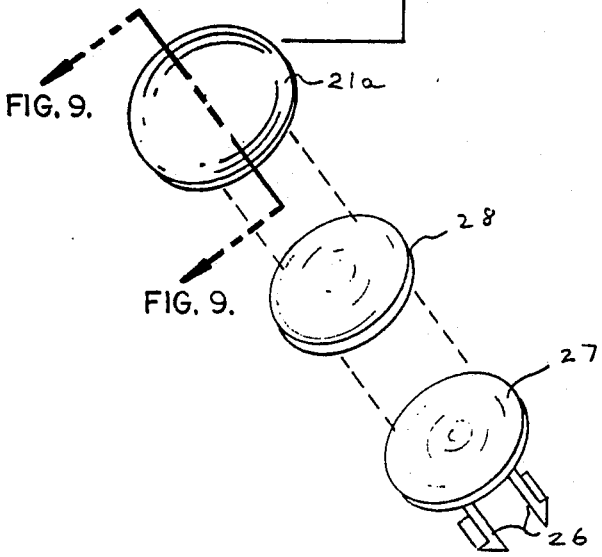
FIG. 8 is an isometric illustration of the instant invention, as illustrated in FIGS. 6 and 7, for the use of a resilient covering dome.
Figure 9:
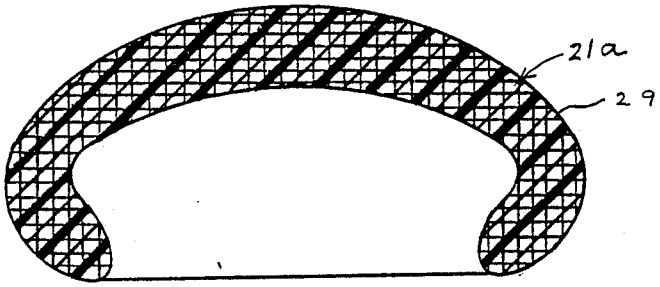
FIG. 9 is an orthographic cross-sectional view taken along the lines 9—9 of FIG. 8 in the direction indicated by the arrows.
Figure 10:
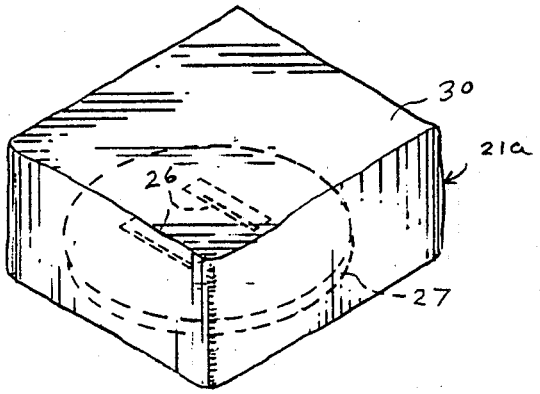
FIG. 10 is an isometric illustration of the covering dome deformed into a further configuration.
Figure 11:
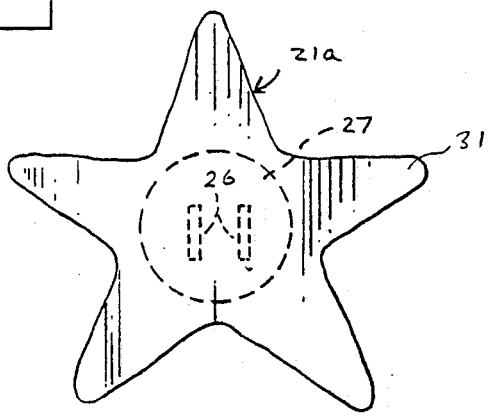
FIG. 11 is a top orthographic view of the covering dome, as illustrated in FIG. 9, deformed into a yet further configuration.

FIG. 7 illustrates the annular cover plate 27, wherein the plate 27 is formed of a magnetic material to effect attraction of a magnetically attractive cover disk 28. The diameter of the cover disk 28 is substantially equal to the diameter of the disk 27, and wherein the cover disk 28 is formed of various colorations to provide various color coordinations by a user of the assembly. FIG. 8 illustrates the use of a modified dome **21*a* mounted to overlie the cover disk 28 and the cover plate 27. The modified dome is formed of a soft latex rubber (see FIG. 9), including a bendable wire mesh matrix 29 formed coextensively and imbedded throughout the modified dome 21*a* to enable selective deformation of the dome by an individual and to enable that dome to maintain the self-configured shape, as illustrated in FIGS. 10 and 11, illustrating the reconfiguration of the dome 21*a* into a respective cube 30 or star 31**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A button cover assembly comprising, in combination, a button means for securement to a fabric support, and a cover member including a plurality of spaced projection hooks orthogonally and fixedly mounted to a bottom surface of the cover member selectively securable to the button means, and wherein the cover member is of a cylindrical configuration defined by a cover member diameter, and wherein the button means includes a support disk defined by a support disk diameter, the cover member diameter and the support disk diameter substantially equal, and wherein the support disk includes a plurality of spaced slots, the slots spaced apart a predetermined distance, and the projection hooks spaced apart the predetermined distance, wherein the projections hooks are receivable within the spaced slots, and the support disk further including an arcuate semi-annular ring defined by terminal ends, each terminal end fixedly mounted to a bottom surface of the support disk, and wherein the ring is orthogonally oriented relative to the bottom surface of the support disk.

2. An apparatus set forth in claim 1 wherein the cylindrical cover member is formed of a magnetic material, and the assembly further includes a cover disk, the cover disk magnetically adherable to a top surface of the cover member, and is defined by a cover disk diameter substantially equal to the predetermined diameter, and the cover disk formed in a variety of colorations.

3. An apparatus as set forth in claim 2 further including a semi-spherical hollow dome defined by a "C" shaped configuration defining an internal cavity, the internal cavity substantially equal to the predetermined diameter, and wherein the dome is formed of a deformable latex rubber.

4. An apparatus as set forth in claim 3 wherein the dome includes a bendable wire mesh matrix coextensively directed throughout the dome, the bendable wire mesh matrix permitting a shape-retaining configuration to be selectively imparted to the dome.

* * * * *